United States Patent [19]

Klingel et al.

[11] Patent Number: 4,570,327

[45] Date of Patent: Feb. 18, 1986

[54] DIE HOLDER MECHANISM FOR A STAMPING MACHINE OR THE LIKE

[75] Inventors: Hans Klingel, Moeglingen, Fed. Rep. of Germany; Alfred Matheis, Winsted, Conn.

[73] Assignee: Trumpf GmbH & Co., Ditzingen, Fed. Rep. of Germany

[21] Appl. No.: 618,207

[22] Filed: Jun. 7, 1984

[30] Foreign Application Priority Data

Jun. 9, 1983 [DE] Fed. Rep. of Germany ..... 3320825

[51] Int. Cl.[4] ..... B23Q 3/00

[52] U.S. Cl. ..... 29/568; 83/698; 279/87

[58] Field of Search ..... 83/698, 690; 279/76, 279/83, 87; 29/568

[56] References Cited

U.S. PATENT DOCUMENTS

| | | | |
|---|---|---|---|
| 1,387,339 | 8/1921 | Banister | 279/87 |
| 3,719,117 | 3/1973 | Mauk et al. | 83/698 |
| 3,721,154 | 3/1973 | Leibinger et al. | 83/698 |
| 3,797,352 | 3/1974 | Smith | 279/87 |

*Primary Examiner*—James M. Meister
*Assistant Examiner*—John L. Knoble

[57] ABSTRACT

A die or like tooling is precisely oriented in a horizontal attitude for lowering into a tool-receiving recess in a machine frame by moving it against a guide member projecting above the tool holder and then moving both tool and guide member downwardly to seat the tool. To ensure proper alignment and attitude, the guide member and tool have a cooperating recess and projection. The machine tool desirably includes a locking member to retain the members in the depressed position.

5 Claims, 5 Drawing Figures

DIE HOLDER MECHANISM FOR A STAMPING MACHINE OR THE LIKE

BACKGROUND OF THE INVENTION

The present invention relates to machine tools of the type having a frame with a tool holding recess in the bed, and more specifically, to a method and apparatus for effecting alignment and movement of a die in a precise attitudinal position in registry with the tool holding recess.

A number of machine tools employ cooperating tooling in the head and bed of the machine frame; punch presses and nibbling machines are notable examples. In such machines, the punch is typically inserted horizontally into a tool holder in the upper frame, and that holder has a recess for receiving and aligning it. The bottom tool or die must be moved over the die holder in the bottom of the frame of the machine and then pushed downwardly into a recess in the bed. In order to guarantee precise and firm seating of the die in the die holder, there must be a close fit between the abutting surfaces of the die and the recess of the die holder in which it is seated.

The peripheral contours of the die and the cooperating recess in which it is seated are frequently circular, but the circular configuration can be interrupted by projecting portions and recesses. However, the cross-section of the recess in which the die is seated generally must remain constant from its open upper end to its bottom wall; a bevel or chamfer will not normally be utilized because the upper surface of the die must be flush with the surface of the die holder thereabout to support the sheet metal or other workpiece. As a result, the need for a close fitting relationship between the periphery of the die and the recess and the die holder makes insertion of the die into the die holder quite difficult because even a slight deviation from a perfectly horizontal attitude will make its movement downwardly thereinto almost impossible.

As is well known, the die holder in the frame will also have an opening in its bottom wall for discharge of scrap and the like. Although it is common for the die holder to be a separate element supported on the machine frame, it can be fabricated as a part of the bed of the frame, and the term "tool holder" as used herein contemplates a separate tool holder providing the tool-receiving recess or merely a portion of the frame doing so.

It is an object of the present invention to provide a novel machine tool operation in which a die or like tooling can be positively oriented and guided downwardly into a cooperating recess in the machine frame.

It is also an object to provide such a method in which the die or like tooling is precluded from rotation upon seating in the cooperating recess in the machine bed.

Another object is to provide a unique machine tool assembly wherein the die may be precisely oriented in the desired horizontal attitude and moved readily into position within a cooperating die recess in the machine bed.

Still another object is to provide such a machine tool wherein the die and die receiving element may be readily fabricated, and are of rugged and durable construction.

SUMMARY OF THE INVENTION

It has now been found that the foregoing and related objects can be readily attained by operating of a machine tool which includes a tool holder with a recess in its upper surface, and a guide member movably supported in the tool holder at one point about the periphery of the recess and movable between a first elevated position extending above the upper surface of the holder and a second depressed position in which it does not extend above the upper surface. The guide member is caused to move into its first elevated position, and a generally flat, substantially disc-shaped tool is moved against the guide member. One of the guide member and tool has a recess about its periphery which receives a peripheral portion on the other of the tool and guide member to position the tool in a predetermined position and in a horizontal attitude.

The tool and guide member are then depressed relative to the tool holder to seat the tool in the recess and to cause the guide member to move into its second, depressed position. The guide member is then releasably engaged in its depressed position within the the tool holder.

In a preferred embodiment, spring means biases the guide member towards its first elevated position, and depressing the guide member and the tool overcomes the biasing pressure of the spring means. Fastener means is moved substantially perpendicularly to the axis of movement of the guide means to effect the step of engagement of the guide means in its depressed position.

In one embodiment, the tool and tool holder are provided with cooperatively dimensioned and configured arcuate recesses therein which, when aligned, define a cylindrical cavity and the guide member is of generally circular cross-section to seat in the cylindrical cavity to effect alignment and preclude rotation.

The tool preferably includes a projecting arm about its periphery providing the interfitting peripheral portion, and the guide member is configured with an arcuate surface portion seating against the periphery of the tool about the arm portion and with a recess seating the arm portion.

The preferred machine tool includes a machine frame having a base, a tool holder in the base providing a tool-receiving recess in its upper surface, and a generally flat, substantially disc-shaped tool cooperatively dimensioned and configured to seat snugly in the recess upon movement downwardly thereinto. A guide member is movably supported on the base at one point about the periphery of the tool-receiving recess for movement between a first elevated position extending above the upper surface of the holder and a second depressed position wherein it does not extend above the upper surface. This guide member has a recess formed in the upper end thereof opening at one point about the periphery thereof and abutting the tool-receiving recess in the depressed position of the guide member. The tool member has a peripheral portion seating in the guide member recess, and one of the tool member peripheral portion and the guide member recess has a projection seated in a cooperating recess in the other. This orients the tool member in a horizontal attitude in alignment with the tool-receiving recess when the guide member is in its elevated position, and the tool member and guide member are moved downwardly simultaneously relative to the tool holder upon initial positioning of the tool member to seat said tool member in said tool-receiving recess.

Preferably, the recess in the guide member has an arcuate portion and a central polygonal portion, and the tool has a projecting arm portion seated in the central polygonal portion. There is also included biasing means biasing the guide member into its elevated position, and engagement means for releasably engaging the guide member in its depressed position.

BRIEF DESCRIPTION OF THE ILLUSTRATED EMBODIMENTS

DETAILED DESCRIPTION OF THE ILLUSTRATED EMBODIMENTS

Figure 1:
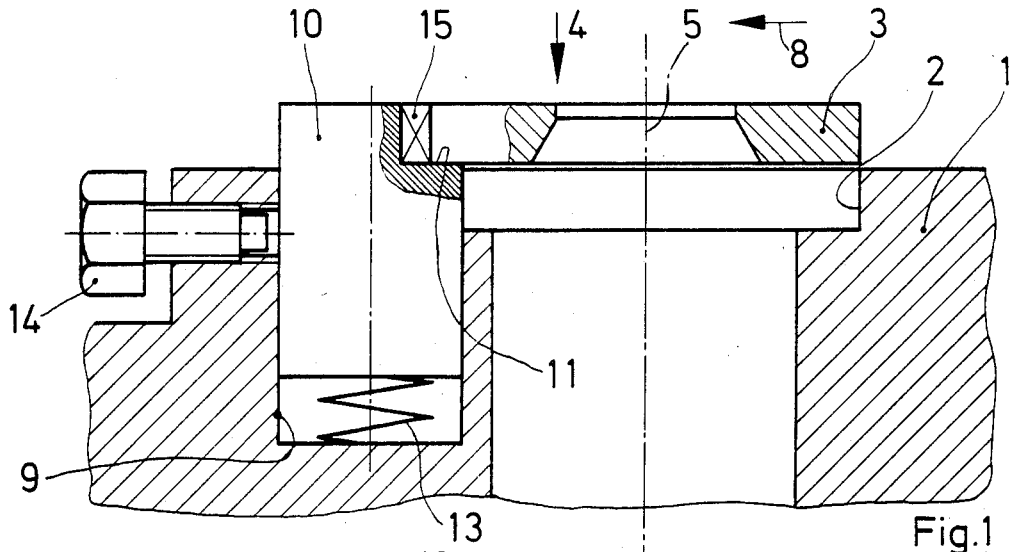
FIG. 1 is a fragmentary cross-sectional view of a tool holder and die assembly embodying the present invention with the die guide member and locking member in the elevated position during insertion of the die.
Figure 2:
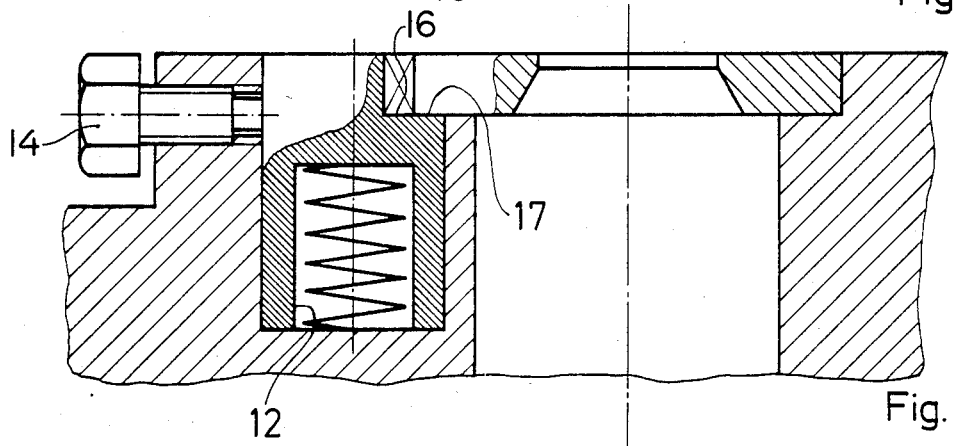
FIG. 2 is a similar view with the members moved into their depressed position wherein the die is in position to perform work upon sheet metal workpieces disposed thereon.
Figure 3:
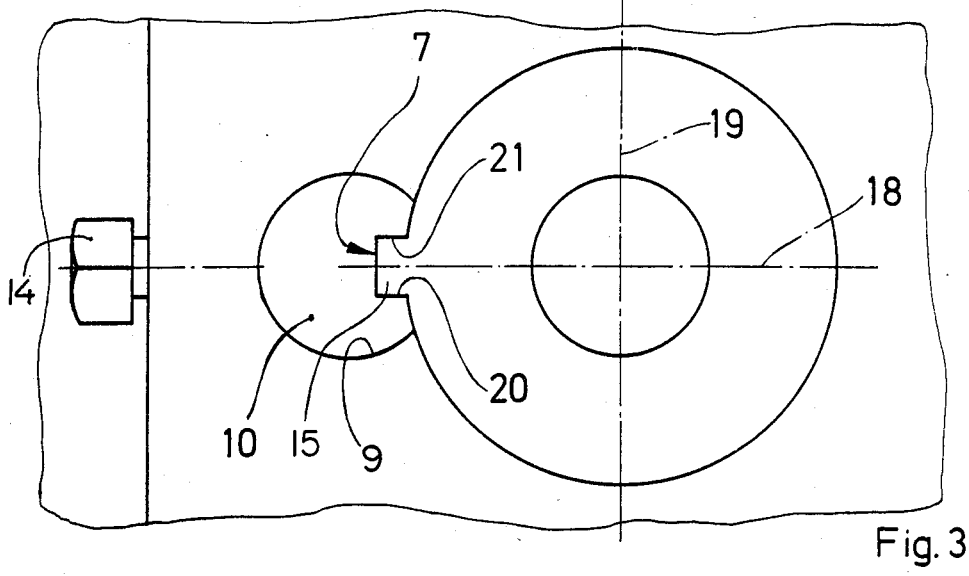
FIG. 3 is a plan view thereof.

Turning first to the embodiment of FIGS. 1–3, a die holder of a type conventionally provided on the bed of a punch press or the like (not shown) is designated by the numeral 1 and has a generally circular recess 2 in its upper surface. The die recess 2 is cooperatively configured and dimensioned with respect to a generally disc-shaped die 3 having a projecting arm portion 15.

Conventionally, the die 3 will be the lower part of a cutting tool assembly and its internal cavity will cooperate, with a punch (not shown) having the same cross-section as that of the internal cavity. The die holder recess 2 and die 3 are of equal height so that, as seen in FIG. 2, the die 3 snugly seats within the recess 2 and has its top surface extending in the same plane as the top surface of the die holder 1.

To seat the die 3 in the recess 2, the die 3 must be moved in the direction of the arrow 8 and precisely aligned with the recess 2 and then moved downwardly in perfect horizontal attitude alignment as indicated by the arrowhead 4 of FIG. 1. If the die 3 is at all angularly disposed with respect to the work axis 19 as it is moved into the die recess 2, insertion will be difficult if not impossible because of the tight dimensioning of the two elements.

As best seen in FIG. 3, a guide bore 9 is disposed at one point about the periphery of the die recess 2, and it is of generally circular cross section and defines a circle which intersects the circle defining the periphery of the die recess 2. Slidably seated in the guide bore 9 is a guide member or connecting link 10 which is movable between an elevated position seen in FIG. 1, and a depressed position seen in FIG. 2 wherein its upper surface is flush with the upper surface of the die holder 1 and die 3. The guide member 10 is normally biased upwardly by a compression spring 13 seated within the counterbore 12 opening at the base thereof and bearing upon the bottom wall of the guide bore 9. Extending horizontally in the die holder 1 is a locking screw 14 which can be threadably engaged to lock the guide member 10 in the depressed position seen in FIG. 2.

The guide member 10 has a recess 17 formed at a point about its upper surface facing the die recess 2, and that recess 17 is configured to provide a transversely extending groove 16 including a pair of arcuate wall portions cooperating with the contour of the die recess 2 (and die 3) and a centrally disposed transverse groove 16 of generally rectangular cross-section.

The die 3 has a projecting arm portion 15 thereon which is cooperatively dimensioned and configured with respect to the transverse groove 16 so that it will snugly fit therein against the locating surface or end wall 7 and the lateral side walls 20,21.

Figure 4:
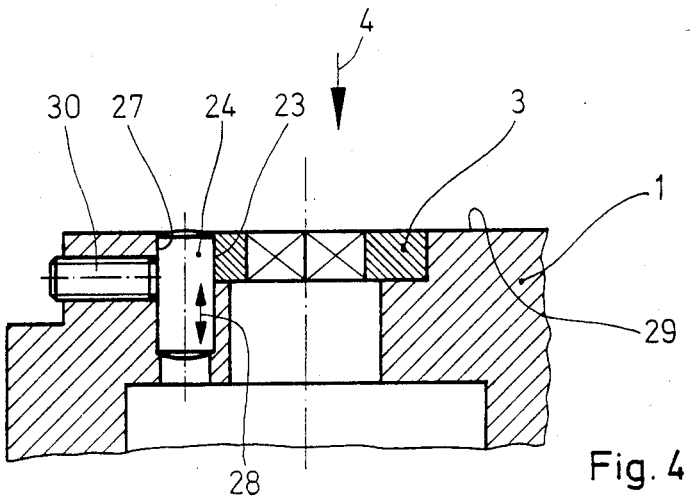
FIG. 4 is a fragmentary sectional view of another tool holder and die assembly embodying the present invention with the parts in their depressed work performing position.
Figure 5:
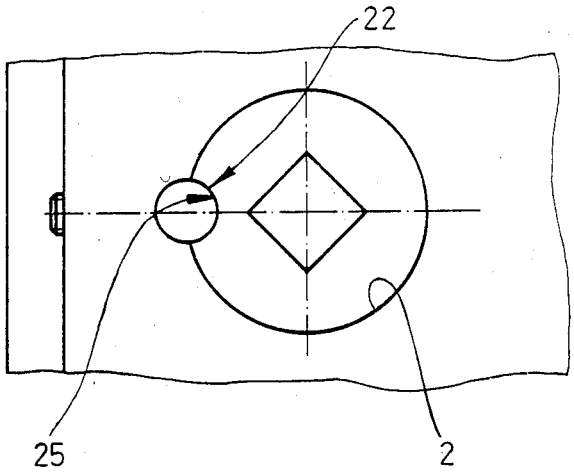
FIG. 5 is a plan view thereof.

Turning now to the embodiment of FIGS. 4 and 5, the die holder 1 is again provided with a generally circular recess 2 in its upper surface seating the die 3 which is also of generally circular cross-section. In the illustrated embodiment, the central aperture of the die 3 is of generally rectangular cross-section.

At one point about the periphery of the die recess 2 is located a circular guide bore 27 in which is seated the guide member generally designated by the numeral 22 and comprising a generally cylindrical bolt 24 which will move upwardly and downwardly within the bore 27 as indicated by the arrow 28.

The guide member 27 provides a longitudinal or axial guide surface 23 of arcuate cross-section which seats in the arcuate recess 25 formed at one point about the periphery of the die 3.

It will be appreciated that the manner for effecting the depression or elevation of the die and guide member may vary. In highly automated machines, a piston or other suitable means may be utilized to effect such depression. However, the necessary movement is readily effected manually as is the rotation of the locking screw to hold the assembly in the working position.

Although the guide member 10 has been depicted as integrally formed and as having the locating recess and abutment surfaces formed integrally thereon, it will be appreciated that it can be comprised of plural components and that the locating recess may be replaced by a suitable projection to engage in a comparable configuration recess in the die.

Moreover, the projection on the guide member may comprise a portion of a regular peripheral configuration (as seen in the cylindrical embodiment of FIGS. 4 and 5).

In either of the illustrated embodiments, the die is moved horizontally against the guide member surface which is projecting above the die holder. When the cooperating recess and projection are interfitted fully, the die is in the proper horizontal attitude and the members may be depressed simultaneously while maintaining the attitude to seat the die readily and correctly within the die holder recess.

Thus, it can be seen that the present invention provides a simple and effective method for initially disposing and lowering the die in the proper horizontal attitude into the die holder recess. Moreover, the proper orientation of the die can also be maintained in the die holder.

Having thus described the invention, we claim:

1. In the operation of a machine tool, the steps comprising:

a. providing a machine tool including a frame, a tool holder on said frame having a recess in its upper surface, and a guide member movably supported in said tool holder at one point about the periphery of said recess and movable between a first elevated position extending above the upper surface of said holder and a second depressed position in which it does not extend above said upper surface;

b. causing said guide member to move into its first, elevated position;

c. moving a generally flat, substantially disc-shaped tool against said guide member, one of said guide member and tool having a recess about its periphery receiving a peripheral portion on the other of said tool and guide member to position said tool member in a predetermined position and in a horizontal attitude above said recess in said tool holder; and d. depressing said tool and guide member relative to said tool holder to seat said tool in said tool holder recess and to cause said guide member to move into its second, depressed position.

2. In the machine tool operation of claim 1, providing spring means biasing said guide member towards its first elevated position, said step of depressing said guide member and said tool overcoming the biasing pressure of said spring means.

3. In the machine tool operation of claim 1, moving fastener means substantially perpendicularly to the axis of movement of said guide means to effect engagement of said guide means in its depressed position.

4. In the machine tool operation of claim 1, providing said tool and said tool holder with cooperatively dimensioned and configured arcuate recesses thereabout which, when aligned, define a cylindrical cavity and wherein said guide member is of generally circular cross-section seating in said cylindrical cavity to effect alignment and preclude rotation.

5. In the machine tool operation of claim 1, providing a tool with a projecting arm about its periphery defining said peripheral portion, and providing a said guide member configured with an arcuate surface portion seating against the periphery of said tool about said arm portion and with a recess seating said arm portion.

* * * * *